United States Patent [19]

Kamimura

[11] Patent Number: 5,063,828

[45] Date of Patent: Nov. 12, 1991

[54] ACTUATOR WITH A LOCK MECHANISM

[75] Inventor: Toshio Kamimura, Gifu, Japan

[73] Assignee: Teijin Seiki Co., Ltd., Osaka, Japan

[21] Appl. No.: 323,561

[22] Filed: Mar. 14, 1989

[30] Foreign Application Priority Data

Mar. 23, 1988 [JP] Japan ..... 63-37787[U]

[51] Int. Cl.[5] ..... F15B 15/26

[52] U.S. Cl. ..... 92/26; 92/27; 92/85 B; 92/107; 92/110; 91/23; 91/44; 91/405

[58] Field of Search ..... 92/26, 27, 28, 29, 107, 92/108, 172, 85 B, 85 R; 91/41, 44, 23, 399, 405; 74/110

[56] References Cited

U.S. PATENT DOCUMENTS

| | | | |
|---|---|---|---|
| 2,349,244 | 5/1944 | Brown | 91/44 |
| 3,023,739 | 3/1962 | Dickson, Jr. et al. | 91/405 |
| 3,186,305 | 6/1965 | Lorimer | 92/108 |
| 3,251,278 | 5/1966 | Royster | 92/27 |
| 3,726,187 | 4/1973 | Lewis | 92/108 |
| 4,033,235 | 7/1977 | Berg | 91/405 |

FOREIGN PATENT DOCUMENTS

| | | | |
|---|---|---|---|
| 52-1380 | 7/1977 | Japan | 92/27 |
| 0994820 | 2/1983 | U.S.S.R. | 92/27 |

*Primary Examiner*—Edward K. Look
*Assistant Examiner*—Christopher M. Verdier
*Attorney, Agent, or Firm*—Rothwell, Figg, Ernst & Kurz

[57] ABSTRACT

An actuator including a cylinder having a longitudinal bore, a piston slidably and sealingly inserted into the cylinder, and a lock mechanism for temporarily locking the piston, the cylinder including a cylinder body having the longitudinal bore, a cylinder formed at a front end of the cylinder body and accommodating the lock mechanism, and a front wall connected to the cylinder head at a position opposite to the front end of the cylinder body and having a hole formed therein, the piston including a piston head slidably and sealingly inserted into the cylinder bore, the piston rod projecting from the piston head and slidably insertable into the hole of the front wall, a key groove formed on the piston rod at a position near the piston head, and a longitudinal hole formed within the piston head and the piston rod, wherein the diameter of the piston rod decreases from a backward position adjacent to the key groove to a forward position spaced from the piston head.

5 Claims, 2 Drawing Sheets

ACTUATOR WITH A LOCK MECHANISM

FIELD OF THE INVENTION

The present invention relates to an actuator with a lock mechanism, which actuator comprises a cylinder and a piston movable in the cylinder, and which is further provided with a lock mechanism for temporarily locking the piston to the cylinder.

BACKGROUND OF THE INVENTION

An example of a conventionally known actuator with a lock mechanism is illustrated in FIG. 3. The actuator comprises a cylinder 3, a piston 4 slidably mounted in the cylinder 3, and a lock mechanism 10. The cylinder 3 has inlet and outlet ports 1 and 2 for supplying and exhausting working fluid and a front wall disposed at the front end thereof. The piston 4 includes a piston head 5 and piston rod 7 connected to the piston head 5. The lock mechanism 10 temporarily locks the piston 4 to the cylinder 3 by engaging a key 9 with a key groove 8 formed at an outer periphery of base portion of the piston rod 7, when the piston head 5 reaches the extended stroke end A, i.e., a position away from an inner surface 6 of the front wall by a predetermined distance L.

When such an actuator with a lock mechanism is used as, for example, an actuator for taking in and out wheels of an aircraft, a longitudinal hole 11 extending from the piston head 5 toward the front end is usually formed in the piston 4 so as to make the piston hollow as illustrated in FIG. 4 in order to lessen the weight of the actuator. In order to minimize the weight, it is preferable that the inner diameter of the longitudinal hole 11 is as large as possible. However, in order to maintain the strength of the piston, it is necessary that the thickness of the piston rod 7 is almost the same over the entire region of the piston rod 7. In order to satisfy both the above-described requirements regarding minimization of the weight and the sufficient strength, it is necessary that the longitudinal hole 11 includes a shoulder therein, i.e., the diameter of the longitudinal hole 11 is set small near the key groove 8 and is set large at the remaining region. Accordingly, there is a problem that the boring operation of the longitudinal hole 11 is troublesome, and that correspondingly, the manufactured actuator becomes expensive.

SUMMARY OF THE INVENTION

It is an object of the present invention to provide an actuator with a lock mechanism which can be manufactured easily and economically.

It is another object of the present invention to provide an actuator with a lock mechanism which is inexpensive.

According to the present invention, the above-described objects are achieved by an actuator comprising a cylinder having a longitudinal bore formed therein, a piston slidably and sealingly inserted into the cylinder, and a lock mechanism for temporarily locking the piston, wherein the cylinder comprises:

- a cylinder body having the longitudinal bore formed therein;
- a cylinder head formed at a front end of the cylinder body and accommodating the lock mechanism; and

- a front wall connected to the cylinder head at a position opposite to the front end of the cylinder body and having a hole formed therein, a distance between the end of the cylinder body and an inner surface of the front wall is set at a predetermined length, the piston comprises:

- a piston head slidably and sealingly inserted into the bore of the cylinder bore;
- a piston rod projecting from the piston head and slidably inserted into the hole of the front wall; and
- a key groove formed on the piston rod at a position near the piston head, the piston has a longitudinal hole formed within the piston head and the piston rod, a diameter of the piston rod decreases when it is observed along the piston rod from a backward position adjacent to the key groove to a forward position spaced from the piston head by the predetermined length, and the lock mechanism includes a key engagable with the key groove on the piston rod when the piston moves forwardly to an extended stroke end thereof.

In the actuator with a lock mechanism according to the present invention, it is possible that the cylinder further comprises an inner cylinder formed therein and slidably and sealingly engaging with the longitudinal hole of the piston.

An actuator with a lock mechanism is usually provided at the front portion of the cylinder with a space for accommodating the lock mechanism. Accordingly, the extended stroke end of the piston head, i.e., the position of the piston head when it fully moves forward, locates away from the inner surface of the front wall of the cylinder by a predetermined distance, i.e., the axial length of the accommodating space. As a result, the portion on the piston rod, which portion locates between the key groove and the front wall of the cylinder when the piston head is positioned at its extended stroke end, does not engage with the front wall of the cylinder even when the piston moves back and forth.

The inventor of the present invention focused on the above-described fact, and he constructed the piston rod in such a manner that the region except for the key groove in the above-mentioned portion of the piston rod is tapered, in other words, the diameter of the piston rod decreases at the above-mentioned portion when it is observed along the piston rod from a backward position adjacent to the key groove to a forward position spaced from the piston head by the above-mentioned predetermined length. Thus, the diameter of the piston rod at the base portion adjacent to the key groove is larger than that of the piston rod at the front end thereof.

As a result, the minimization of the weight and the maintenance of the strength can be compatible with each other in the actuator of the present invention, and further, when a longitudinal hole is bored in the piston, the hole can be straight but not shouldered, i.e., the diameter of the hole is the same at the entire region. Thus, the actuator of the present invention can be manufactured easily and can be inexpensive.

BRIEF DESCRIPTION OF THE DRAWINGS

An embodiment of the present invention will now be explained in detail with reference to the accompanying drawings, wherein.

DETAILED DESCRIPTION OF THE INVENTION

Figure 1:
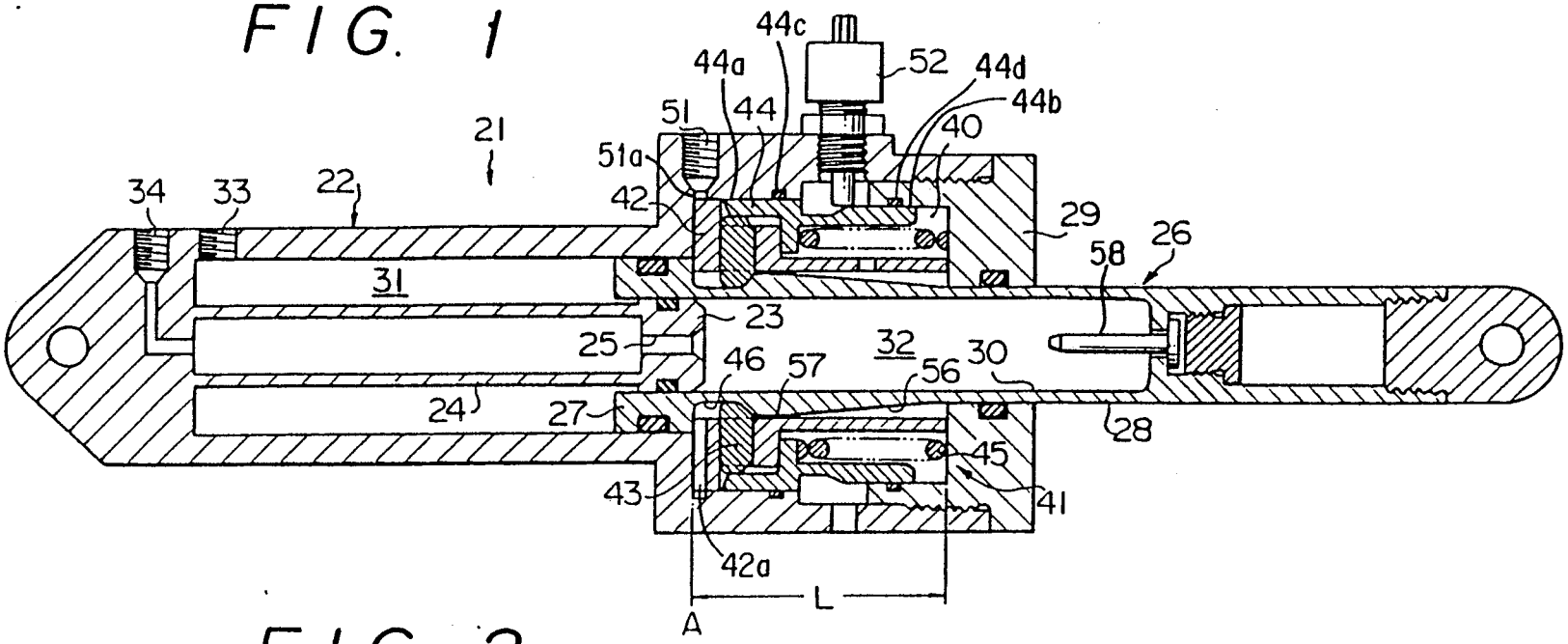
FIG. 1 is a cross sectional front view of an embodiment of the present invention.
Figure 2:
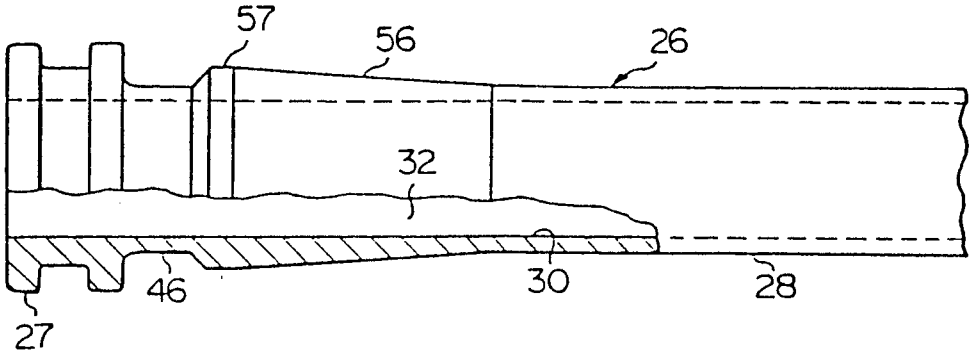
FIG. 2 is a partially cross sectioned front view of a piston installed in the embodiment illustrated in FIG. 1.
Figure 3:
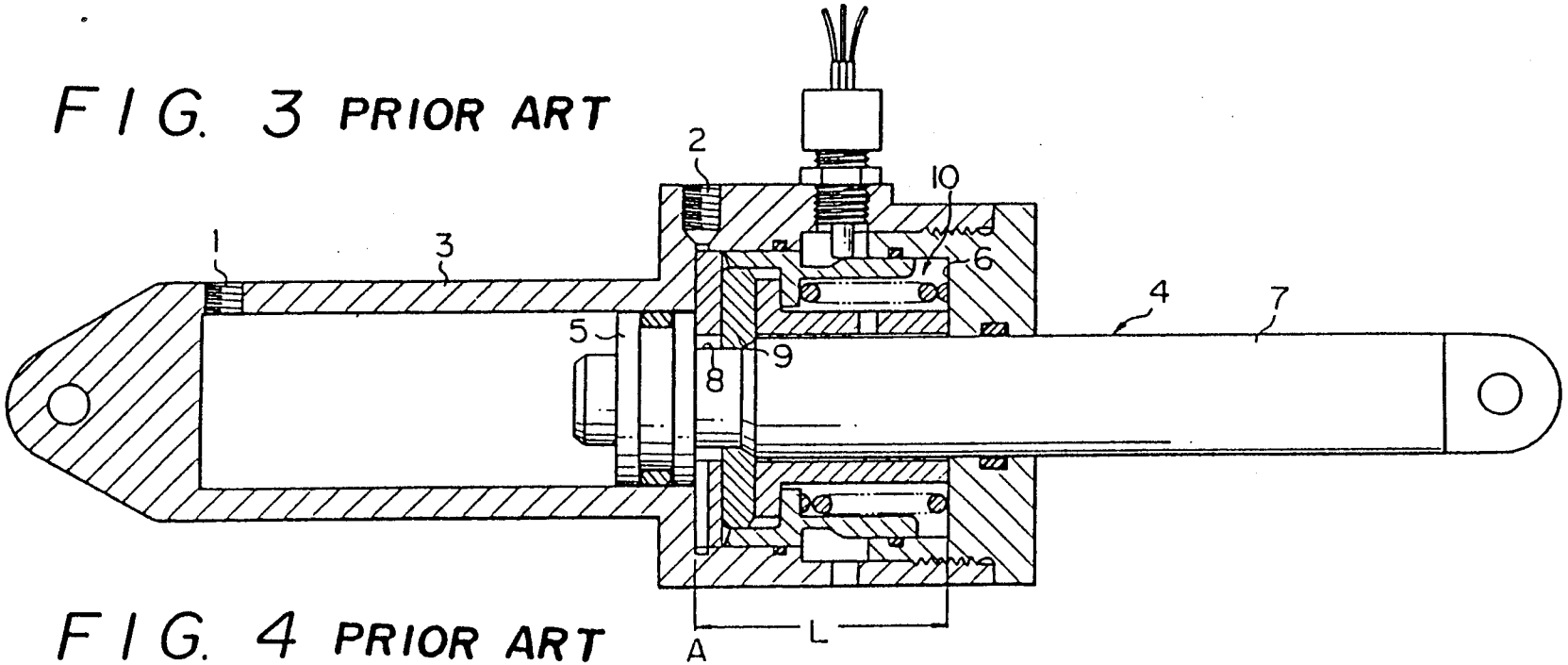
FIG. 3 PRIOR ART
FIG. 3 is a cross sectional front view of a conventional actuator with a lock mechanism.
Figure 4:
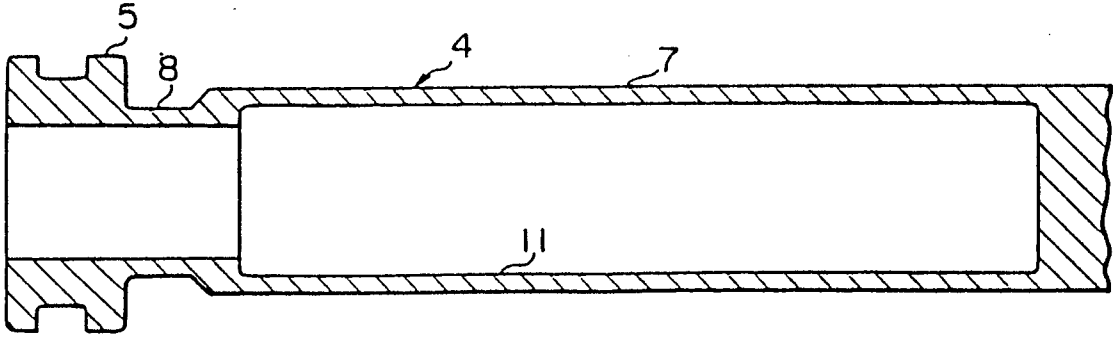
FIG. 4 PRIOR ART
FIG. 4 is a cross sectional front view of a piston illustrated in FIG. 3.

In FIGS. 1 and 2, reference numeral 21 denotes an actuator with a lock mechanism, which actuator is used for taking in and out wheels of an aircraft and which is provided with a cylinder body 22 with a bore formed therein. A rear end of the cylinder body 22 will be connected to the fuselage of an aircraft (not shown).

The cylinder body 22 has an inner cylinder 24 coaxially mounted therein. The inner cylinder 24 has a bottom wall 23 at the front end thereof, i.e., the right end in FIG. 1, which wall is provided with a small penetrating hole 25. The rear end, i.e., the left end in FIG. 1, of the inner cylinder 24 is connected to the rear end, i.e., the left end in FIG. 1, of the cylinder body 22.

A piston 26 comprises a piston head 27, which is slidably and sealingly inserted into the bore of cylinder body 22, and a piston rod 28, base, i.e., the left end, of which is connected to the piston head 27. The piston rod 28 penetrates a hole formed in a front wall 29 of the cylinder, and its front end, i.e., the right end in FIG. 1, will be connected to the wheel of the aircraft (not shown).

The piston 26 has a straight hole 30 longitudinally formed therein, i.e., the diameter of the longitudinal hole 30 is the same at any position along the axial direction of the piston 26. The above-described inner cylinder 24 is slidably inserted into the longitudinal bole 30. Thus, a first cylinder chamber 31 is formed at a space surrounded by the cylinder body 22, the inner cylinder 24 and the head 27, and a second cylinder chamber 32 is formed in the longitudinal hole 30 partitioned by the bottom wall 23 of the inner cylinder 24.

A first port 33 is formed at the rear end of the cylinder body 22 and communicates with the first cylinder chamber 31. In case of emergency, working fluid is supplied into the first cylinder chamber 31 through the first port 33.

Further, a second port 34 communicating with the second cylinder chamber 32 through the inside of the inner cylinder 24 is formed at the rear end of the cylinder body 22. When the piston 26 is normally moved forwardly, the second cylinder chamber 32 is supplied with working fluid through the inner cylinder 24 and the penetrating hole 25.

The extended stroke end A of the piston head 27, i.e., the position of the piston head 27 when it moves forward to its stroke end, is away in a backward direction from the inner surface of the front wall 29 of the cylinder body 22 by a predetermined length L, because the piston head 27 abuts with a guide 42 of a lock mechanism 41 which is disposed between the stroke end A and the front wall 29 and is forced to stop there. As illustrated in the lower portion of FIG. 1, the guide 42 has a radial passage 42*a* formed on its surface.

The lock mechanism 41 is accommodated in a lock chamber 40 which is formed within a cylinder head formed at a front end of the cylinder body 22 and which surrounds the periphery of the piston rod 28. The lock mechanism 41 includes the above-described guide 42 attached to the cylinder body 22, a plurality of radially movable keys 43, ram 44 for inwardly pressing the keys 43 in radial direction when they move backwardly, and a compression spring 45 for urging the ram 44 in a backward direction. Referring to FIG. 1, the ram 44 has a portion 44*a* with a large diameter and a portion 44*b* with a small diameter so that a difference in the area for receiving pressure is formed. The ram 44 is slidably and sealingly inserted into the cylinder head 22 via seals 44*c* and 44*d*, respectively.

The lock mechanism 41 inserts the radial inner ends of the keys 43 into a key groove 46 which is formed at the periphery of the base portion of the piston rod 28 and extends in a circumferential direction of the piston rod 28, and accordingly, the piston 26 is temporarily locked to the cylinder.

Reference numeral 51 denotes a third port formed at the cylinder head and is connected to an annular groove 51*a* formed at the inner surface of the cylinder head 22 as illustrated in FIG. 1. When the piston 26 is required to be retracted, working fluid is supplied into the lock chamber 40 through the third port 51. The working fluid under pressure supplied through the third port 51 passes through the annular groove 51*a* formed at the inside of the cylinder head 22, the passage 42*a* formed on the guide 42, and clearances formed between the guide 42 and the keys 43, which clearances permit the sliding of the keys 43 and the fluid flows into the lock chamber 40. Since the ram 44 has a difference in area for receiving pressure, the ram 44 is moved to the right in FIG. 1 against the spring force of the compression spring 45. Thus, the keys 43 can move outwardly in a radial direction, and accordingly, the locking is released.

Reference numeral 52 denotes a sensor of a limit switch type which is screwed to the cylinder head and which detects the locking condition by abutting the outer surface of the ram 44.

A tapered portion 56 of a frustum of cone shape is formed on the piston rod 28 at a base portion of the piston rod 28.

The term "tapered" means that a diameter of the piston rod 28 decreases when it is observed along the piston rod 28 from a backward position to a forward position.

The term "base portion of the piston rod" means a region substantially between the key groove 46 and the front wall 29 of the cylinder when the piston head 27 locates its extended stroke end A, in other words, a region between a position adjacent to the key groove 46 and a forward position spaced from the piston head 27 by the above-described predetermined length L.

The front end of the tapered portion 56 of the piston head 28 is connected to a circular column having a small constant diameter, which is, however, slightly larger than that of the key groove 46.

Further, a cylindrical portion 57 with a large constant diameter is disposed between the key groove 46 and the rear end of the tapered portion 56 so that the keys 43 can smoothly slide thereon.

In addition, it is preferred that the inclination of the tapered portion 56 is set small so that the sliding resistance of the key 43 is lowered when the piston rod 28 is extended. Reference 58 denotes a snubbing piston projecting from the front end of the piston 26 into the second cylinder chamber 32. When the piston 26 is retracted to a position near the retracted strike end, the snubbing piston 58 penetrates into the penetrating hole 25 of the inner cylinder 24 so that the fluid flow from the second cylinder chamber 32 through the penetrating hole 25 is restricted thereby damping the shock caused by the stoppage of the piston.

The operation of the above-described embodiment will now be explained.

When the wheels of the aircraft are taken out, working fluid is supplied to the second cylinder chamber 32 through the second port 34 so as to move the piston 26 forwardly, i.e., to the right in FIG. 1. During the forward movement of the piston 26, the keys 43 slide on the tapered portion 56 and radially and outwardly move. Since the inclination of the tapered portion 56 is set small as described above, the sliding resistance between the keys 43 and the tapered portion 56 scarcely increases, and the forward movement of the piston rod 28 is not adversely influenced.

When the piston head 27 reaches the extended stroke end A and abuts with the guide 42, the piston head 27 stops its forward movement. At this moment, since the key groove 46 locates at the radial inside of the keys 43, the keys 43 are radially pressed into the key groove 46 by means of the spring 45 via ram 44, and radial inner ends of the keys 43 engage with the key groove 46.

Consequently, the piston 26 is temporarily locked to the cylinder, and the locking condition is detected by the sensor 52.

Since the tapered portion 56 is formed on the specially selected region on the piston rod 28 as described above, the tapered portion 56 does not engage with the front wall 29 of the cylinder even when the piston head 27 reaches the extended stroke end A, and accordingly, the forward movement of the piston rod 28 is not adversely affected.

When the wheels of the aircraft are required to be taken in, the lock chamber 40 is supplied with working fluid through the third port 51. Then, the ram 44 moves forwardly, i.e., to the right in FIG. 1, and at the same time, the piston 26 is retracted. The keys 43 are pressed radially and outwardly because of the movement of the piston 26. Since the ram 44 has been moved forwardly as described above, the movement of the keys 43 is not prevented, and therefore, the keys 43 are disengaged from the key groove 46.

As a result, the temporary lock by the lock mechanism 41 is released, and the piston 26 is retracted to the retracted stroke end, while the sensor 52 detect the released condition.

Since the piston rod 28 has a diameter larger than that of the key groove 46 at a region ahead the tapered portion 56, the keys 43 are projected to such an extent that the top of the keys 43 exceed the ram 44, and accordingly, the ram 44 is prevented from its backward movement by the keys 43 when supply of the working fluid to the lock chamber 40 is stopped. Thus, erroneous detection by the sensor 52 is prevented.

As described above, the tapered portion 56 is formed on the piston rod 28 at a region which does not interact with the front wall 29 of the cylinder, and the diameter of the rear end of the tapered portion 56 adjacent to the key groove 46 is made larger than that of the front portion of the piston rod 28. Accordingly, the longitudinal hole 30 can be straight, i.e., the diameter of the hole 30 is constant at any portions along the axial direction, even when the light weight requirement and the requirement for enlarging the diameter of the longitudinal hole as large as possible are satisfied.

Thus, as explained with reference to the embodiment, the longitudinal hole 30 can be used to define a cylinder chamber. Further, the manufacture of the actuator of the present invention can be easy, and the manufacturing cost can be inexpensive.

In the foregoing embodiment, the tapered portion 56 is formed in a frustum of cone shape, however, the tapered portion 56 may be of a frustum of pyramid shape if the means for preventing relative rotation between the piston 26 and the cylinder is provided.

The present invention is also applicable for actuation of flaps of aircrafts, vehicles and ships.

As described above, the present invention can provide an actuator with a lock mechanism which can be manufactured easily and economically and which is inexpensive, since the longitudinal hole formed in the piston can be straight, i.e., the diameter can be same at any portions.

What is claimed is:

1. An actuator comprising a cylinder having a longitudinal bore formed therein, a piston slidably and sealingly inserted into said cylinder and a lock mechanism for temporarily locking said piston, wherein said cylinder comprises:

a cylinder body having said longitudinal bore formed therein;

a cylinder head formed at a front end of said cylinder body and accommodating said lock mechanism; and a front wall connected to said cylinder head at a position opposite to said front end of said cylinder body and having a hole formed therein, a distance between said end of said cylinder body and an inner surface of said front wall is set at a predetermined length, said piston comprises:

a piston head slidably and sealingly inserted into said bore of said cylinder body;

a piston rod projecting from said piston head and slidably inserted into said hole of said front wall; and a key groove formed on said piston rod at a position near said piston head, said piston has a longitudinal hole formed within said piston head and said piston rod, a diameter of said piston rod gradually decreases from a backward position, which is adjacent to said key groove, to a forward position, which is spaced from said piston head by a distance substantially equal to said predetermined length, when it is observed along said piston rod, and said lock mechanism comprises:

a key which slides on said decreased portion of said piston rod until said piston reaches an extended stroke end and which is engageable with said key groove on said piston rod when said piston moves forwardly to said extended stroke end thereof.

2. An actuator with a lock mechanism according to claim 1, wherein a diameter of said piston rod at a front end thereof is larger than that of said piston rod at said key groove.

3. An actuator with a lock mechanism according to claim 1, wherein said cylinder further comprises an inner cylinder formed therein and slidably and sealingly engaging with said longitudinal hole formed in said piston.

4. An actuator with a lock mechanism according to claim 3, wherein a diameter of said piston rod at a front end thereof is larger than that of said piston rod at said key groove.

5. An actuator comprising:

a cylinder;

an inner cylinder, coaxial with said cylinder, having a closing wall at a front end thereof and connected to said cylinder at a back end thereof;

a hollow piston slidably inserted between an inner surface of said cylinder and an outer surface of said inner cylinder and having a bottom wall at its front end;

a snubbing piston projecting from said bottom wall of said piston in the direction of said back end; and said closing wall of said inner cylinder having a penetrating hole through which said snubbing piston is penetrated forming a restrictive passage there between.

* * * * *

UNITED STATES PATENT AND TRADEMARK OFFICE

CERTIFICATE OF CORRECTION

PATENT NO. : 5,063,828

DATED : November 12, 1991

INVENTOR(S) : Toshio KAMIMURA

It is certified that error appears in the above-identified patent and that said Letters Patent is hereby corrected as shown below:

Col. 3, line 37, delete "bole" and insert therefor --hole--.

Col. 4, line 68, delete "strike" and insert therefor --stroke--.

Signed and Sealed this

Sixth Day of July, 1993

Michael K. Kirk

*Attest:*

MICHAEL K. KIRK

*Attesting Officer*

*Acting Commissioner of Patents and Trademarks*